US011194278B2

(12) United States Patent
Matsui

(10) Patent No.: US 11,194,278 B2
(45) Date of Patent: Dec. 7, 2021

(54) IMAGE FORMING APPARATUS CAPABLE OF FORMING IMAGE ON BOTH FIRST SIDE AND SECOND SIDE OF SHEET

(71) Applicant: CANON KABUSHIKI KAISHA, Tokyo (JP)

(72) Inventor: Noriaki Matsui, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/081,360

(22) Filed: Oct. 27, 2020

(65) Prior Publication Data

US 2021/0132534 A1 May 6, 2021

(30) Foreign Application Priority Data

Oct. 30, 2019 (JP) ..... JP2019-197645

(51) Int. Cl.
*G03G 15/23* (2006.01)
*G03G 15/00* (2006.01)
*G03G 15/16* (2006.01)

(52) U.S. Cl.
CPC ..... *G03G 15/234* (2013.01); *G03G 15/168* (2013.01); *G03G 15/6564* (2013.01); *G03G 15/6579* (2013.01); *G03G 2215/00548* (2013.01); *G03G 2215/00586* (2013.01); *G03G 2215/00599* (2013.01)

(58) Field of Classification Search
CPC ..... G03G 15/234; G03G 15/6564; G03G 15/6579; G03G 15/168; G03G 2215/00599; G03G 2215/00586; G03G 2215/00548; G03G 21/14
See application file for complete search history.

(56) References Cited

U.S. PATENT DOCUMENTS 8,059,976 B2 * 11/2011 Matsui ..... G03G 15/6561 399/18
8,229,315 B2 * 7/2012 Sakai ..... H04N 1/0061 399/85
10,527,998 B2 1/2020 Matsui et al.
2008/0025737 A1 1/2008 Matsui et al.
2019/0212689 A1 7/2019 Matsui

FOREIGN PATENT DOCUMENTS

JP 2008-052257 A 3/2008

* cited by examiner

*Primary Examiner* — Susan S Lee
(74) *Attorney, Agent, or Firm* — Venable LLP

(57) ABSTRACT

After outputting a first start signal for causing an image forming unit to start formation of an image for a first side of an i-th sheet, a controller causes a feeding member to start feeding of the i-th sheet, and determines whether or not the i-th sheet has already been detected by a detector. In a case where the i-th sheet has been detected before a predetermined time has elapsed, the controller outputs a second start signal for causing the image forming unit to start formation of an image for second side of an (i−1)th sheet. In a case where the i-th sheet has not been detected before the predetermined time has elapsed, the controller outputs the second start signal after the i-th sheet is detected.

10 Claims, 15 Drawing Sheets

IMAGE FORMING APPARATUS CAPABLE OF FORMING IMAGE ON BOTH FIRST SIDE AND SECOND SIDE OF SHEET

BACKGROUND OF THE INVENTION

Field of the Invention

The present invention relates to an image forming apparatus capable of forming an image on both a first side and a second side of a sheet.

Description of the Related Art

Image forming apparatuses for forming a full color image transfer toner images each in a different color from photosensitive drums to an intermediate transfer belt (ITB) and then transfer the toner images from the ITB to a sheet. Such image forming apparatuses, in order to improve productivity, start forming toner images on photosensitive drums before starting to feed a sheet. Incidentally, there are cases where a sheet jam occurs after toner image formation is started. According to U.S. Pat. No. 8,059,976B1, it is proposed to retry feeding a sheet while handling a toner image as an invalid image.

In the related art, there were cases where, when a job for forming an image on both sides of a sheet was processed, sheets would be wasted. If a sheet jam occurs when a toner image for a first side and a toner image for a second side are being formed on an ITB in advance in order to improve productivity, the toner image for the first side held on the ITB cannot be cleaned. Thus, the toner image for the first side is transferred onto a secondary transfer unit, and the secondary transfer unit is fouled. If the toner image for the second side and a sheet pass through the fouled secondary transfer unit, the toner image is formed on the second side of the sheet, but its back side, which is a first side, is fouled by the secondary transfer unit (so-called fouling on the back side). A sheet that is fouled on the back side is defective as a product. Meanwhile, it is conceivable to stop conveying a sheet and then make the user remove the sheet before the sheet is fouled. However, this would be deficient in terms of usability. It would be possible to prevent the fouling on the back side if there were a mechanism to clean the secondary transfer unit in a short time, but such mechanism is expensive. If the toner image formation on the photosensitive drums is started only after confirming that a sheet has been conveyed without jamming, productivity would suffer. In view of this, the present invention aims to provide an image forming apparatus capable of maintaining productivity in double-sided image formation.

SUMMARY OF THE INVENTION

The present invention provides an image forming apparatus for forming an image on both a first side and a second side of a sheet. The apparatus may comprise the following elements: an image forming unit configured to form a toner image on an image bearing member; a feeder configured to feed a sheet; a sheet detector configured to detect the sheet in a first conveyance path for conveying the sheet; a transfer unit configured to transfer the toner image formed on the image bearing member onto the sheet; a controller configured to control a timing for forming the toner image on the image bearing member and a timing for feeding the sheet and to control a conveyance of the sheet so that a timing that a toner image conveyed by the image bearing member arrives at the transfer unit and a timing that the sheet arrives at the transfer unit coincide; a fixing unit configured to fix onto the sheet the toner image transferred onto the sheet from the transfer unit; and a re-feeder configured to re-feed a sheet to the transfer unit in order to transfer a toner image onto a second side of the sheet onto whose first side the toner image has been fixed, wherein the controller is configured to: after outputting a first start signal for causing the image forming unit to start formation of a toner image to be transferred onto a first side of an i-th sheet, cause the feeder to start feeding of the i-th sheet; determine, when a predetermined time has elapsed from when the first start signal was outputted, whether or not the i-th sheet has already been detected by the sheet detector; in a case where the i-th sheet has been detected by the sheet detector before a first predetermined time has elapsed from when the first start signal was outputted, output a second start signal for causing the image forming unit to start formation of a toner image to be transferred onto a second side of an (i−1)th sheet waiting at the re-feeder; and in a case where the i-th sheet has not been detected by the sheet detector before the first predetermined time has elapsed from when the first start signal was outputted, output the second start signal after the i-th sheet is detected by the sheet detector.

Further features of the present invention will become apparent from the following description of exemplary embodiments (with reference to the attached drawings).

DESCRIPTION OF THE EMBODIMENTS

Figure 1:
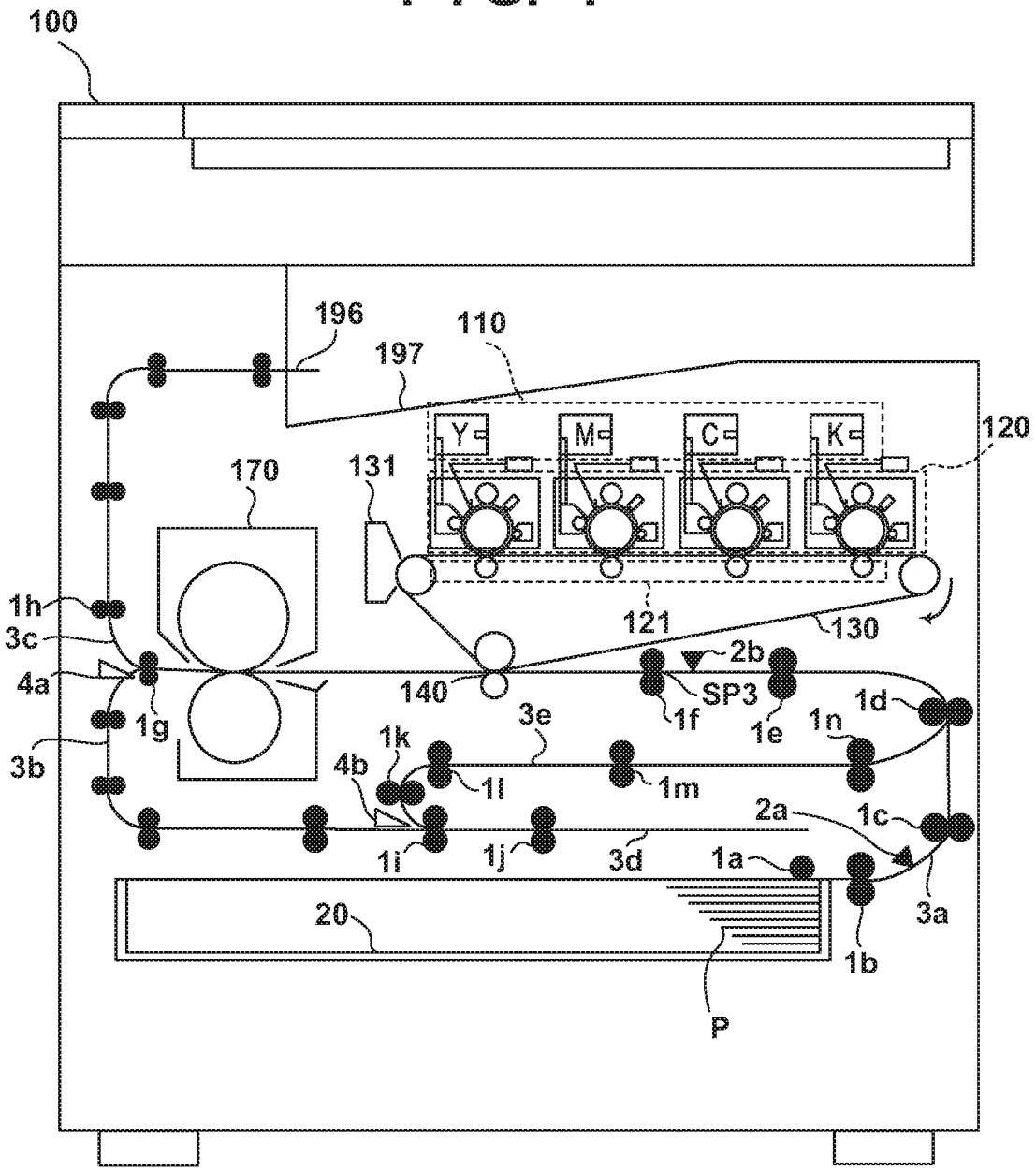
FIG. 1 is a diagram for describing an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

<Image Forming Apparatus>

Figure 2:
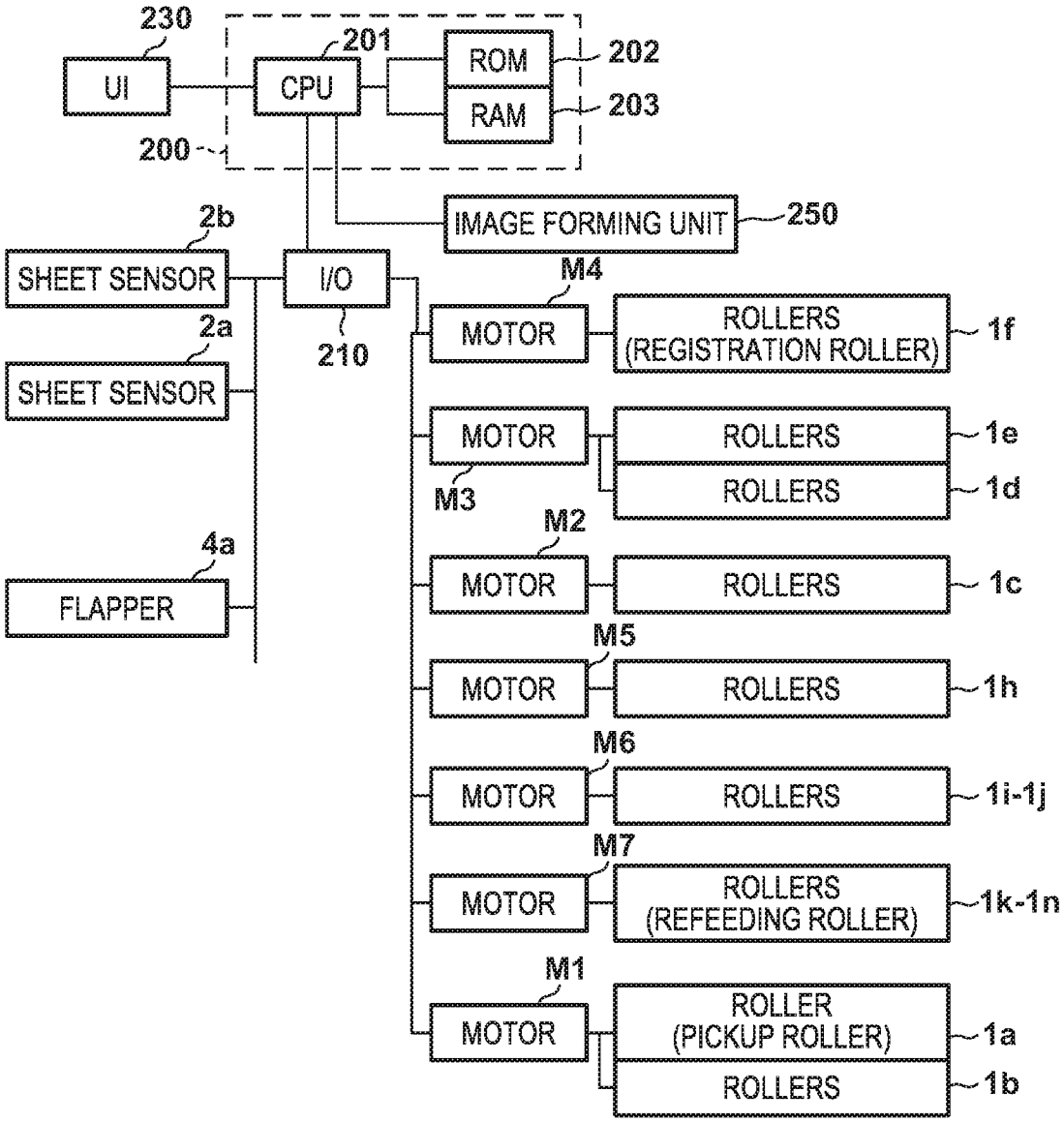
FIG. 2 is a diagram for describing a control system.

An image forming apparatus 100 is able to form an image on both sides of sheets P as illustrated in FIG. 1. FIG. 2 illustrates a control system of the image forming apparatus 100. A control unit 200 has a CPU 201, a ROM 202, and a RAM 203. The CPU 201 controls image formation and conveyance of the sheets P in accordance with a control program stored in the ROM 202. The CPU 201 saves in the RAM 203 and manages a position of each sheet, a position of an image, and such in a conveyance path. Sheet sensors 2*a* and 2*b*, a flapper 4*a*, and motors M1 to M7 are connected to the CPU 201 via an I/O 210. Although other sheet sensors and motors are also connected to the CPU 201, their relation to the present invention is small, and thus, are not illustrated.

When a print instruction is inputted to the CPU 201 from a UI 230, the CPU 201 starts control of an image forming unit 250. The CPU 201 controls generation of a charging voltage and a developing voltage for a processing unit 120 via the image forming unit 250 and generation of a transfer voltage and a cleaning voltage for a secondary transfer unit 140. Also, the CPU 201 controls rotation of a transfer belt 130 and driving of an exposure device 110 via the image forming unit 250. Furthermore, the CPU 201 controls a temperature of a fixing device 170 to a target temperature via the image forming unit 250.

In a case where feeding is performed from a feeding cassette 20, the CPU 201 drives the motor M1 via the I/O 210, and then causes the motor M1 to rotate rollers 1*a* and 1*b*. By this, the sheets P contained in the feeding cassette 20 are fed one at a time to a conveyance path 3*a*. The conveyance path 3*a* is a main conveyance path present from the feeding cassette 20 to the flapper 4*a*. The CPU 201 uses the sheet sensor 2*a* in order to monitor whether or not feeding of the sheet P is successful. The roller 1*a* is sometimes called a pickup roller. The rollers 1*b* are sometimes called separation rollers. When feeding is successful, the CPU 201 drives the motors M2 and M3 and thereby rotates rollers 1*c*, 1*d*, and 1*e*. The rollers 1*c*, 1*d*, and 1*e* are conveyance rollers for conveying the sheets P from an upstream side to a downstream side.

The CPU 201 may control rotation of rollers 1*f* via the motor M4 in accordance with a timing when the leading edge of the sheet P reaches the sheet sensor 2*b*. By this, a timing when a toner image conveyed by the transfer belt 130 arrives at the secondary transfer unit 140 and a timing when the sheet P arrives at the secondary transfer unit 140 is matched. The rollers 1*f* are sometimes called registration rollers. Note that in a case where the timing when the leading edge of the sheet P arrives at the sheet sensor 2*b* is earlier than a set timing, the CPU 201 stops the sheet P when the sheet P abuts against the rollers 1*f*. A position of the leading edge of the sheet P here is denoted as SP3. The CPU 201, after stopping the sheet P for a time such that the timing when the toner image arrives at the secondary transfer unit 140 and the timing when the sheet P arrives at the secondary transfer unit 140 coincide, activates the motor M4 to thereby convey the sheet P to the rollers 1*f*.

Meanwhile, the CPU 201 causes the exposure device 110 and the processing unit 120 to start image formation so to be on time for the timing when the sheet P arrives at the secondary transfer unit 140. As is widely known, the processing unit 120 has photosensitive drums, developing devices, charging rollers, drum cleaners, and such. The image forming unit 250 uniformly charges a surface of the photosensitive drum and then causes the exposure device 110 to irradiate a laser beam onto the photosensitive drum. By this, an electrostatic latent image is formed on the photosensitive drum. The image forming unit 250 develops the electrostatic latent image with the developing device to thereby form a toner image. A primary transfer unit 121 transfers the toner image from the photosensitive drum to the transfer belt 130. The image forming unit 250 rotates the transfer belt 130 and then conveys the toner image to the secondary transfer unit 140. A belt cleaner 131 cleans and collects toner remaining on the transfer belt 130 that was not transferred onto the sheet P by the secondary transfer unit 140. Note that the image forming unit 250, by applying the cleaning voltage to the secondary transfer unit 140, retransfers the toner adhered to the secondary transfer unit 140 to the transfer belt 130 and then collects the toner in the belt cleaner 131. The polarity of the cleaning voltage is the opposite of the polarity of the transfer voltage for transferring the toner image onto the sheet P.

By the transfer belt 130 and the secondary transfer unit 140 conveying the sheet P sandwiched therebetween, the sheet P is conveyed to the fixing device 170. The fixing device 170 fixes the toner image onto the sheet P by adding heat and pressure in relation to the sheet P and the toner image.

The conveyance path 3*a* branches out to conveyance paths 3*c* and 3*b* on the downstream side of rollers 1*g*. The CPU 201 guides the sheet P to the conveyance path 3*c* or 3*b* by controlling the flapper 4*a*. In a double-sided printing job, the sheet P onto whose first side an image is formed is guided to the conveyance path 3*b*. Meanwhile, the sheet P onto whose second side an image was formed in the double-sided printing job and the sheet P onto whose first side an image was formed in a single-sided printing job are guided to the conveyance path 3*c*. The CPU 201 drives the motor M5 in order to rotate rollers 1*h* and discharge the sheet P from a discharge port 196 onto a sheet discharge tray 197.

Conveyance paths 3*b*, 3*d*, and 3*e* are also called double-sided conveyance paths as they convey the sheet P to be double-sided printed. The conveyance path 3*b* branches out to conveyance paths 3*d* and 3*e* on the upstream side of rollers 1*i*. Rollers 1*i* and 1*j* pull the sheet P into the conveyance path 3*d* from the conveyance path 3*b* with the motor M6 and then switch from a normal rotation to a reverse rotation. Note that the sheet P may temporarily wait in the conveyance path 3*d*. The sheet P is guided to the conveyance path 3*e* by a flapper 4*b*. The flapper 4*b* is a so-called mechanical flapper. In the conveyance path 3*e*, the sheet P is conveyed by rollers 1*k*, 1*l*, and 1*m*, and a refeed timing of the sheet P is adjusted by rollers 1*n*. The rollers 1*k* to 1*n* are driven by the motor M7. A position of the rollers 1*n* may be called a refeed position SP2. The sheet P conveyed by the rollers 1*n* is fed to the conveyance path 3*a* again. Then, the sheet P is conveyed by the rollers 1*d*, 1*e*, and 1*f* and is fed to the secondary transfer unit 140, and then an image is formed on the second side.

Formation Order (Transfer Order) of Toner Images in Double-Sided Printing Job

A formation order of toner images, in a case where an image is formed on both sides of n sheets of the sheets P and then the side on which the image was formed first is discharged face-down on the sheet discharge tray 197, is as follows. Numbers in a parentheses indicate the formation order (a page number) of the toner images.

(1) A toner image I1*f* transferred on the first side of a first sheet P1

(2) A toner image I2*f* transferred on the first side of a second sheet P2

(3) A toner image I1*b* transferred on the second side of the first sheet P1

(4) A toner image I3*f* transferred on the first side of a third sheet P3

(5) A toner image I2*b* transferred on the second side of the second sheet P2

* * * *

Omitted

* * * *

(2n−2) A toner image Inf transferred on the first side of an n-th sheet Pn (2n−1) A toner image I(n−1)b transferred on the second side of an (n−1)th sheet P(n−1)

(2n) A toner image Inb transferred on the second side of an n-th sheet Pn

Numbers given to the sheets P and the toner images indicate the number of the sheet. An "f" given to toner images indicates a front side (the first side). A "b" given to toner images indicates a back side (the second side). Here, excluding the first toner image and the last toner image, the toner image for the front side and the toner image for the back side are formed alternatingly. In order to achieve high productivity, such alternating printing is effective. Also, a distance from the trailing edge of a preceding toner image to the leading edge of a next toner image on the transfer belt 130 is sometimes called an image formation interval. A distance (a conveyance interval) from the trailing edge of a preceding sheet to the leading edge of the next sheet on the secondary transfer unit 140 is sometimes called a sheet interval. Generally, high productivity is achieved by maintaining a constant image formation interval and sheet interval.

Case 0 where there is No Feed Delay

Figure 3A:
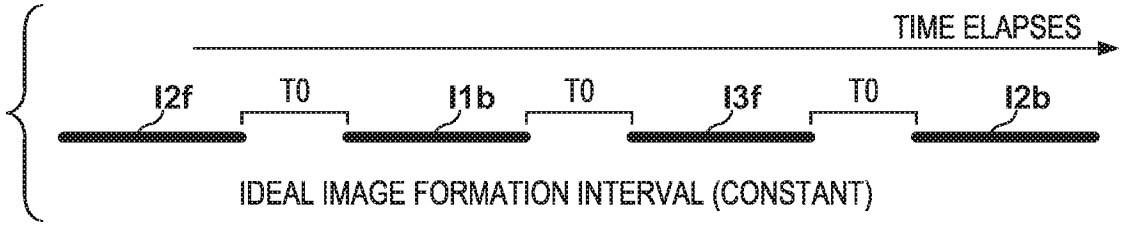
FIGS. 3A to 3D are diagrams for describing image formation intervals.

FIG. 3A illustrates an ideal case 0 where the image formation interval is a constant time T0. The CPU 201 outputs a TOP signal to the image forming unit 250 when the processing unit 120 becomes capable of image formation. By this, the image forming unit 250 outputs the image signal to the exposure device 110, and then toner image formation starts. The TOP signal is a signal for starting toner image formation. However, output timings of TOP signals for a second and subsequent toner images are sometimes adjusted by the CPU 201 in accordance with whether or not the sheet P feed delay is occurring.

Figure 4:
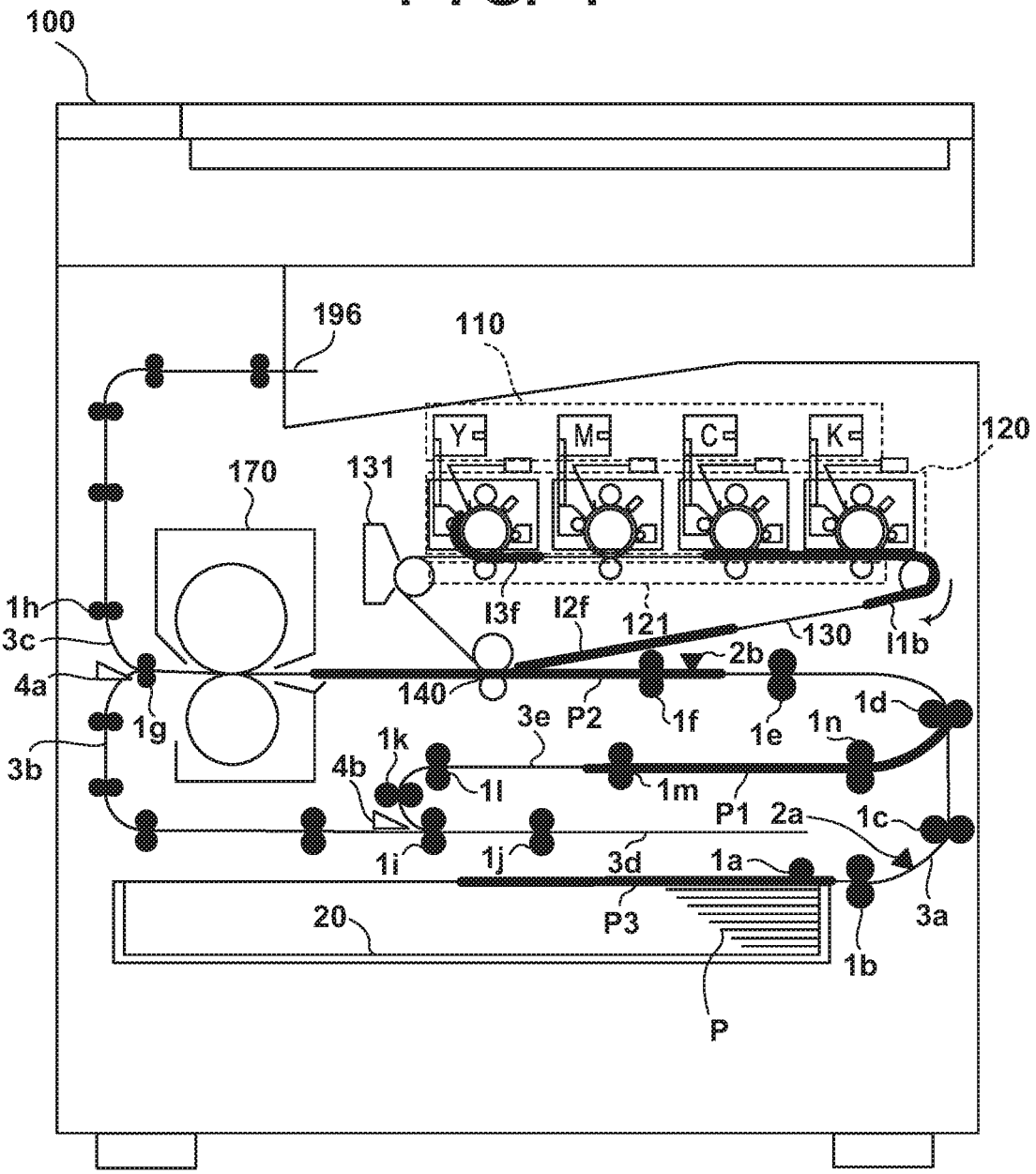
FIG. 4 is a diagram for describing conveyance positions of sheets.

FIG. 4 illustrates positions of toner images and positions of the sheets P in the case 0. Here, the sheet P1 onto whose first side an image is formed is present on the conveyance path 3*e*. In the secondary transfer unit 140, a toner image I2*f* is being transferred onto a first side of a sheet P2. On the transfer belt 130, a toner image I1*b* is being conveyed following the toner image I2*f*. Also, in the processing unit 120, formation of a toner image I3*b* is started. Also, in the feeding cassette 20, feeding of a sheet P3 is started.

Figure 5:
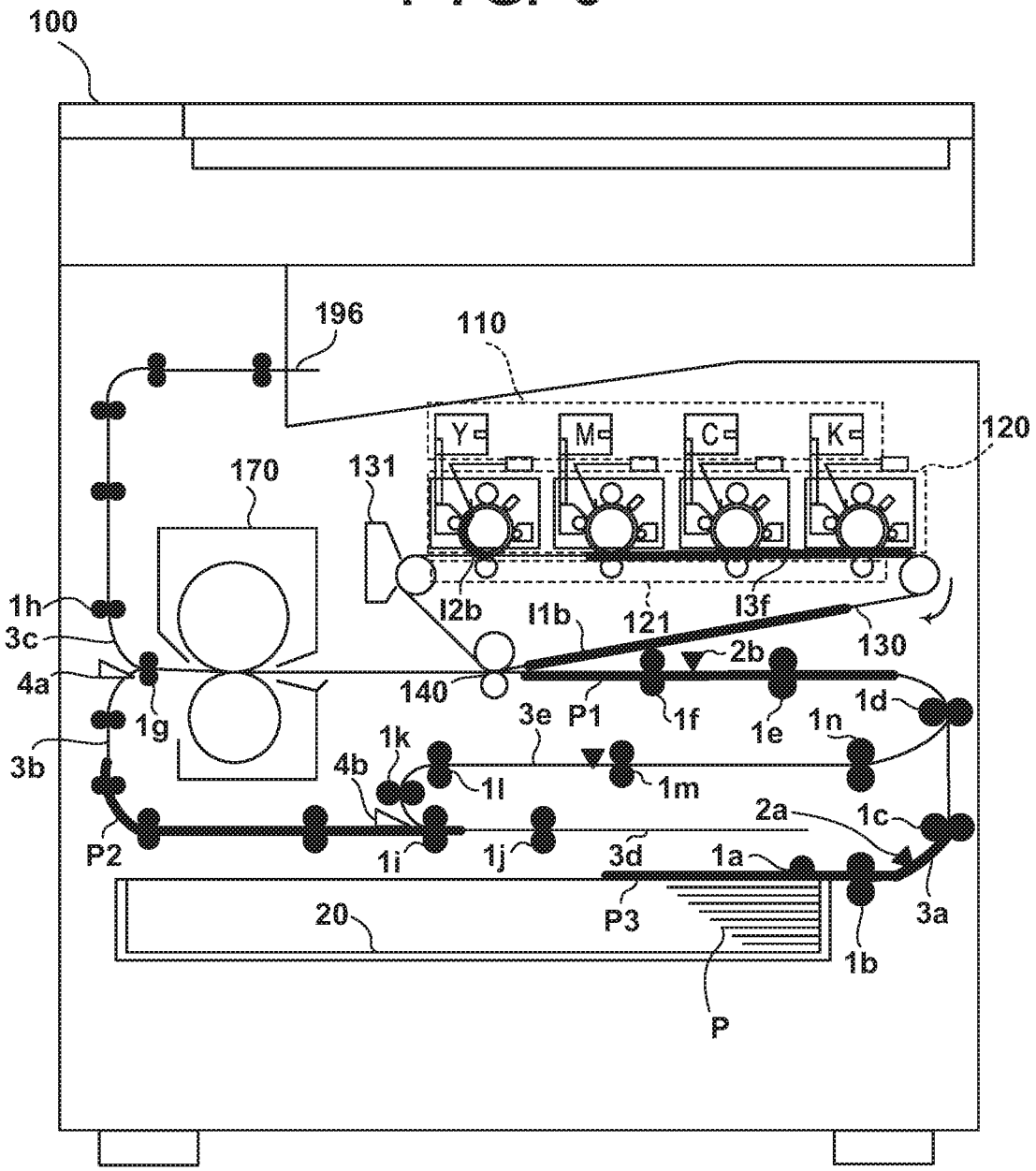
FIG. 5 is a diagram for describing conveyance positions of sheets.

FIG. 5 illustrates positions of toner images and positions of the sheets P at a time later than the time of the case illustrated in FIG. 4. In the secondary transfer unit 140, the toner image I1*b* is being transferred onto a second side of the sheet P1. The sheet P2 on whose first side a toner image is formed is being conveyed through the conveyance paths 3*b* and 3*d*. A sheet P3 is being successfully fed.

Case I where there is Feed Delay

Figure 3B:
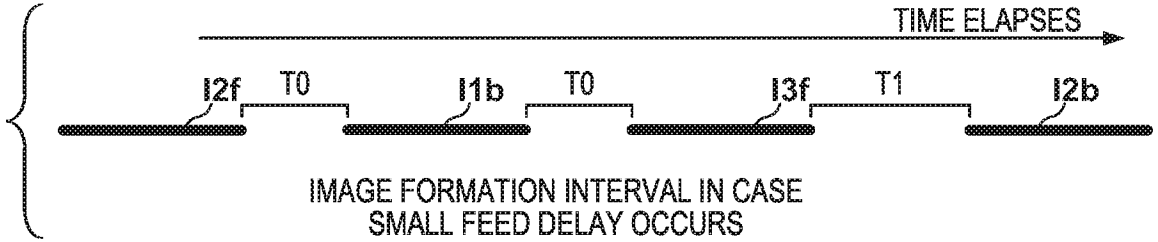
Figure 6:
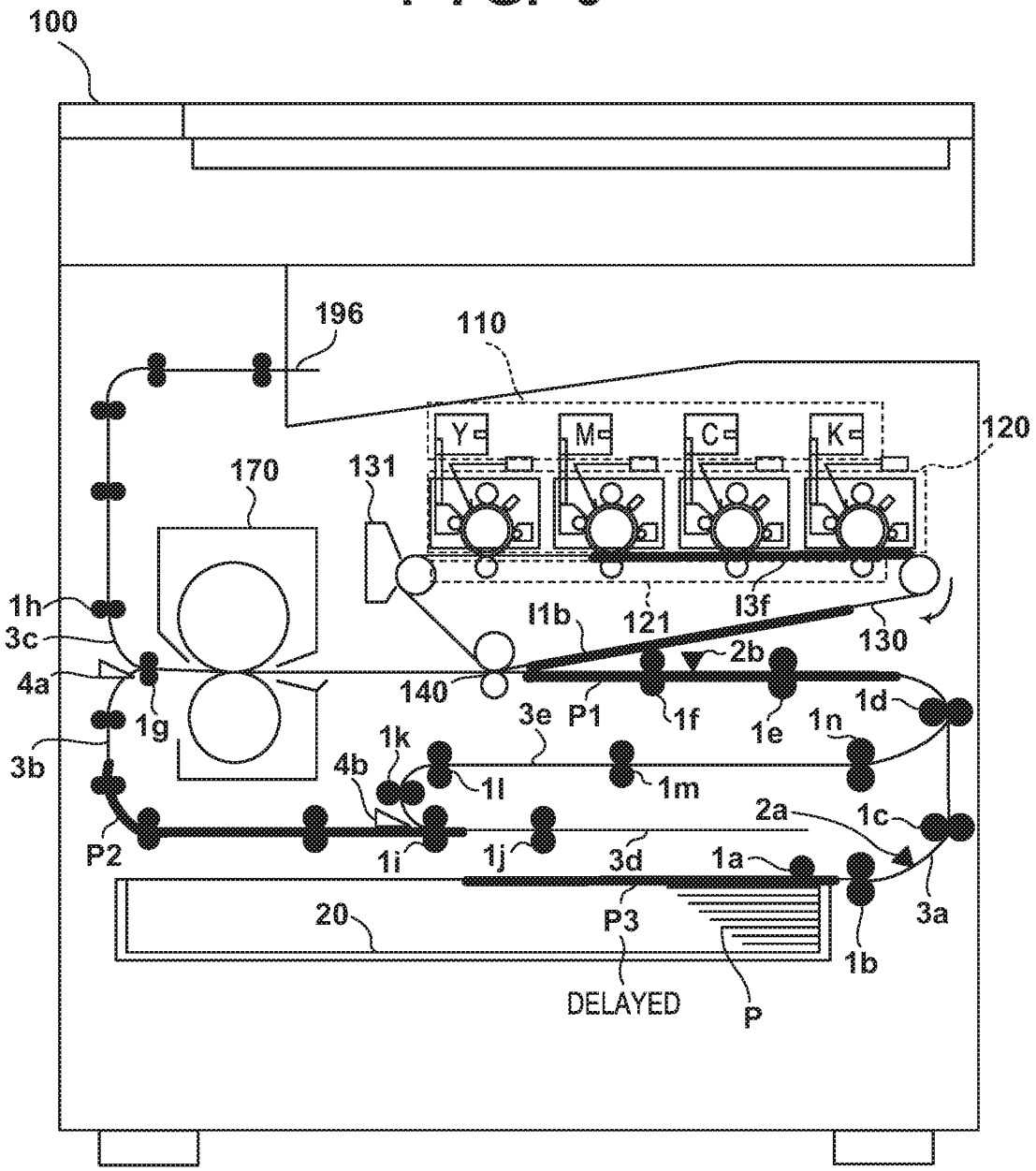
FIG. 6 is a diagram for describing conveyance positions of sheets.

FIG. 3B illustrates a case I where the TOP signal of the toner image I1*b* was caused to be delayed due to a feed delay of the sheet P3 occurring. FIG. 6 illustrates positions of toner images and positions of the sheets P in the case I. The toner image I1*b* is about to be transferred in relation to a second side of the sheet P1. The toner image I3*f* is present on the transfer belt 130. A toner image I2*b* has not been formed yet. As described above, in a case where a length of the feed delay that occurred regarding the sheet P3 is relatively short, the CPU 201 may delay the formation of the toner image I2*b*. As illustrated in FIG. 3B, an image formation interval between the preceding toner image I3*f* and the next toner image I2*b* is T1 (T1>T0).

Figure 7:
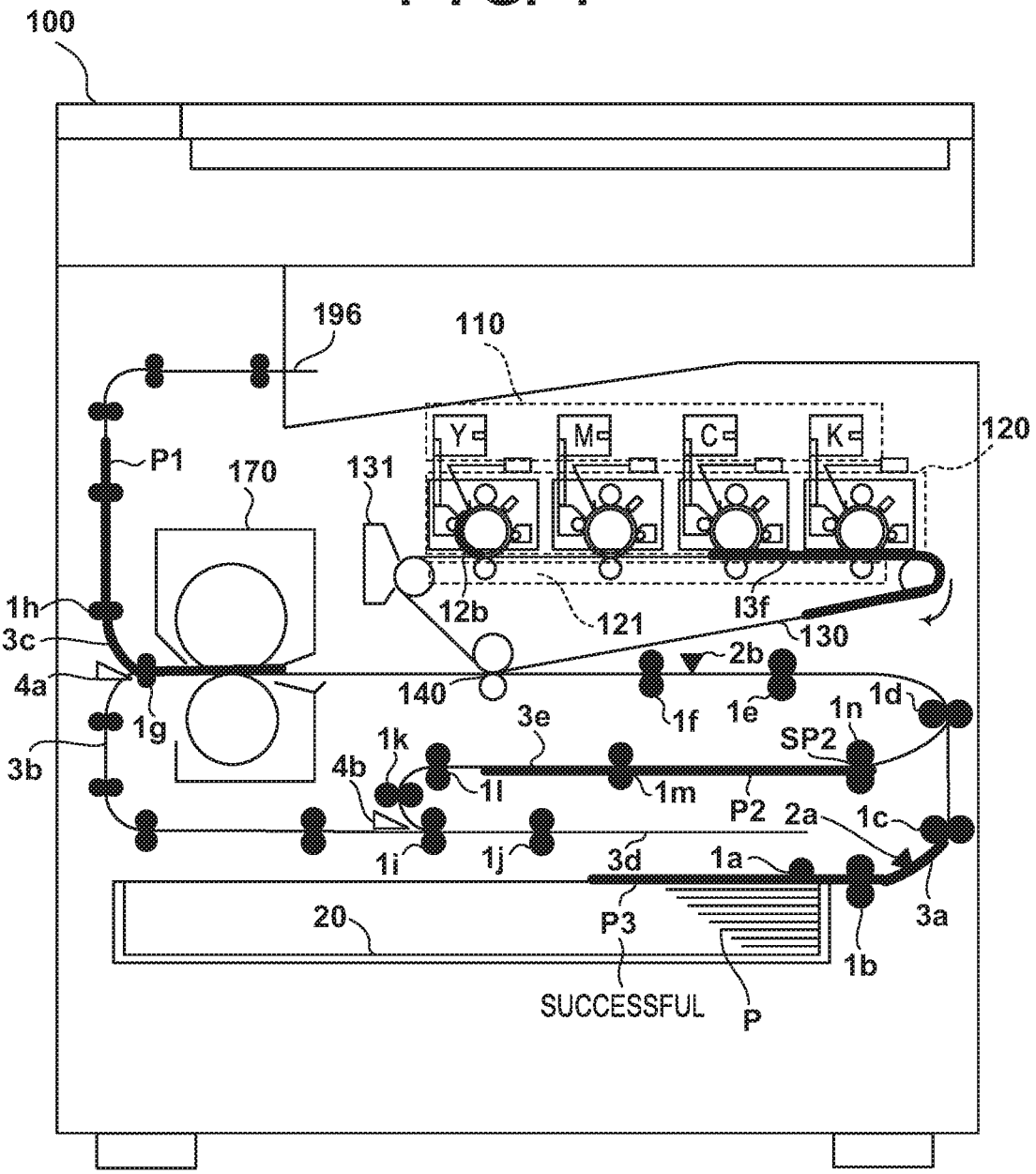
FIG. 7 is a diagram for describing conveyance positions of sheets.

Then, as illustrated in FIG. 7, the sheet P1 whose image formation of the second side is complete is conveyed toward the discharge port 196. The leading edge of the sheet P3 is detected by the sheet sensor 2*a* before a predetermined time Td2 has elapsed from when the CPU 201 started the driving of the motor M1. By this, the CPU 201 determines that feeding of the sheet P3 is successful. In a case where the feeding of the sheet P3 is successful within the predetermined time Td2, by reducing the stop time of the sheet P3 at the rollers 1*f*, the arrival timing of the toner image I3*f* and the arrival timing of the sheet P3 coincide. The CPU 201 causes the processing unit 120 to start image formation of the toner image I2*b* at a timing that the sheet sensor 2*a* is turned on. In other words, the CPU 201 waits until the sheet P3 is detected by the sheet sensor 2*a* and then starts the image formation of the toner image I2*b*. Thus, an image formation interval between the toner image I3*f* and the toner image I2*b* becomes T1 which is longer than an initial value T0. In conjunction with this, the CPU 201 causes the sheet P2 to wait at a standby position SP2 and then re-feeds it.

Case II where there is Feed Delay

Figure 3C:
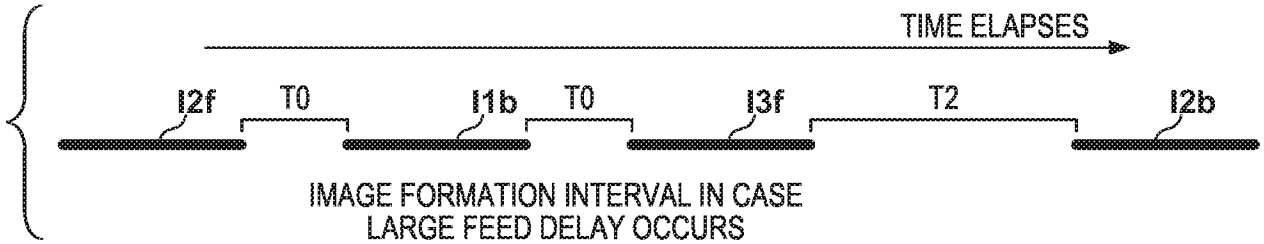
Figure 8:
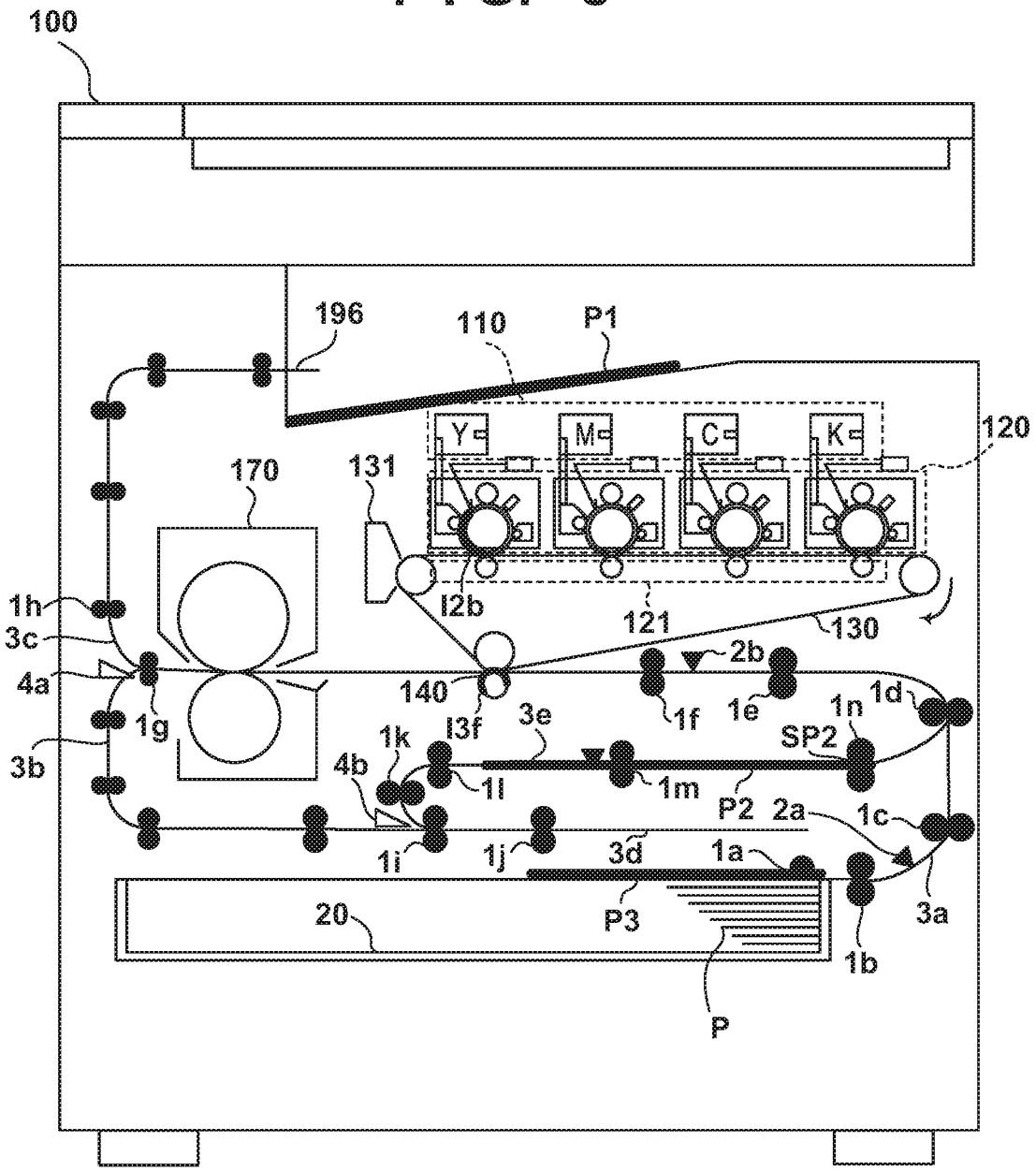
FIG. 8 is a diagram for describing conveyance positions of sheets.
Figure 15:
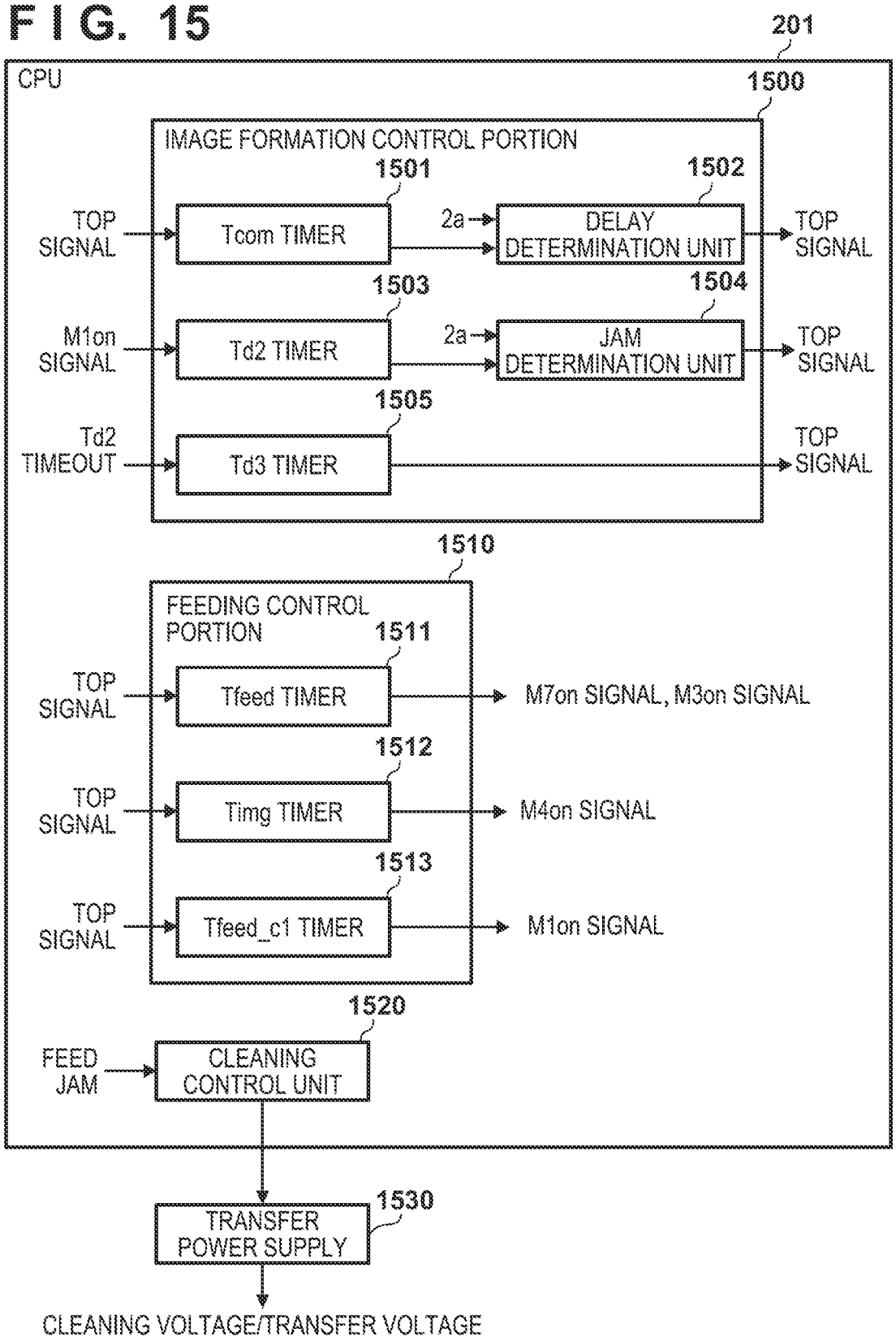
FIG. 15 is a diagram for describing functions of a CPU.

In a case where the feeding of the sheet P3 does not succeed within the predetermined time Td2, the toner image I3*f* can no longer be transferred to the sheet P3. Accordingly, the CPU 201, in a case (FIG. 3C) where the image formation interval between the toner image I3*f* and the toner image I2*b* exceeds T2, starts the image formation of the toner image I2*b* by the processing unit 120. As illustrated in FIG. 8, the CPU 201 cleans the toner image I3*f* adhered to the secondary transfer unit 140 simultaneously to the image formation of the toner image I2*b*. Specifically, the CPU 201 causes the toner image I3*f* to adhere (retransfers) to the transfer belt 130 by applying a cleaning voltage to the secondary transfer unit 140 from a transfer power supply 1530 (FIG. 15). The toner image I3*f* is conveyed to the belt cleaner 131 by the transfer belt 130 and then the belt cleaner 131 collects the toner image I3*f*. The CPU 201 switches from the cleaning voltage to the transfer voltage at a timing such that by the time the toner image I2*b* that is the next page arrives at the secondary transfer unit 140, the switch from the cleaning voltage to the transfer voltage is complete. The time it takes for this switch is called a transition time, and the CPU 201 executes the switch at a timing that is earlier by the transition time to the timing that the toner image I2*b* arrives at the secondary transfer unit 140.

As described above, the CPU 201 is able to resume image formation in a relatively short time by aiming to start the image formation of the toner image I2*b* at a timing when a time T2 has elapsed. Also, the CPU 201 executes re-feeding of the sheet P2 by the rollers In so that the arrival timing of the sheet P2 and the arrival timing of the toner image I2*b* coincide.

Figure 3D:
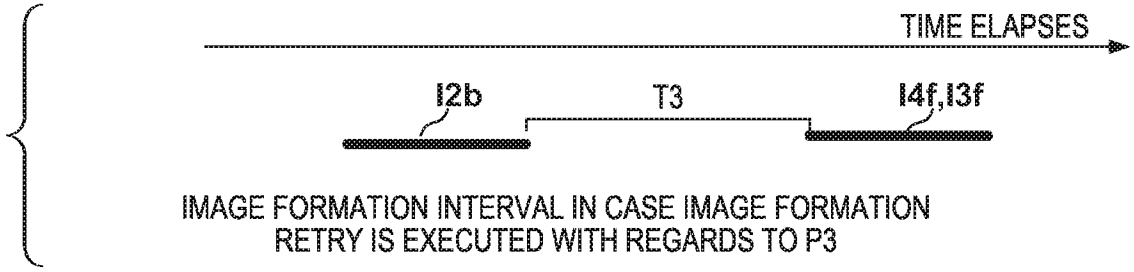

Because the toner image I3*f* was discarded without being transferred, the CPU 201 performs, as illustrated in FIG. 3D, the image formation of the toner image I3*f* again after the toner image I2*b*. This is called an image formation retry. Note that because the toner image I3*f* is already cleaned, the reformed toner image I3*f* may be called a toner image I4*f* in data processing.

<Description Using Sheet Linear Graph>

Ideal Case without Delay

Figure 9:
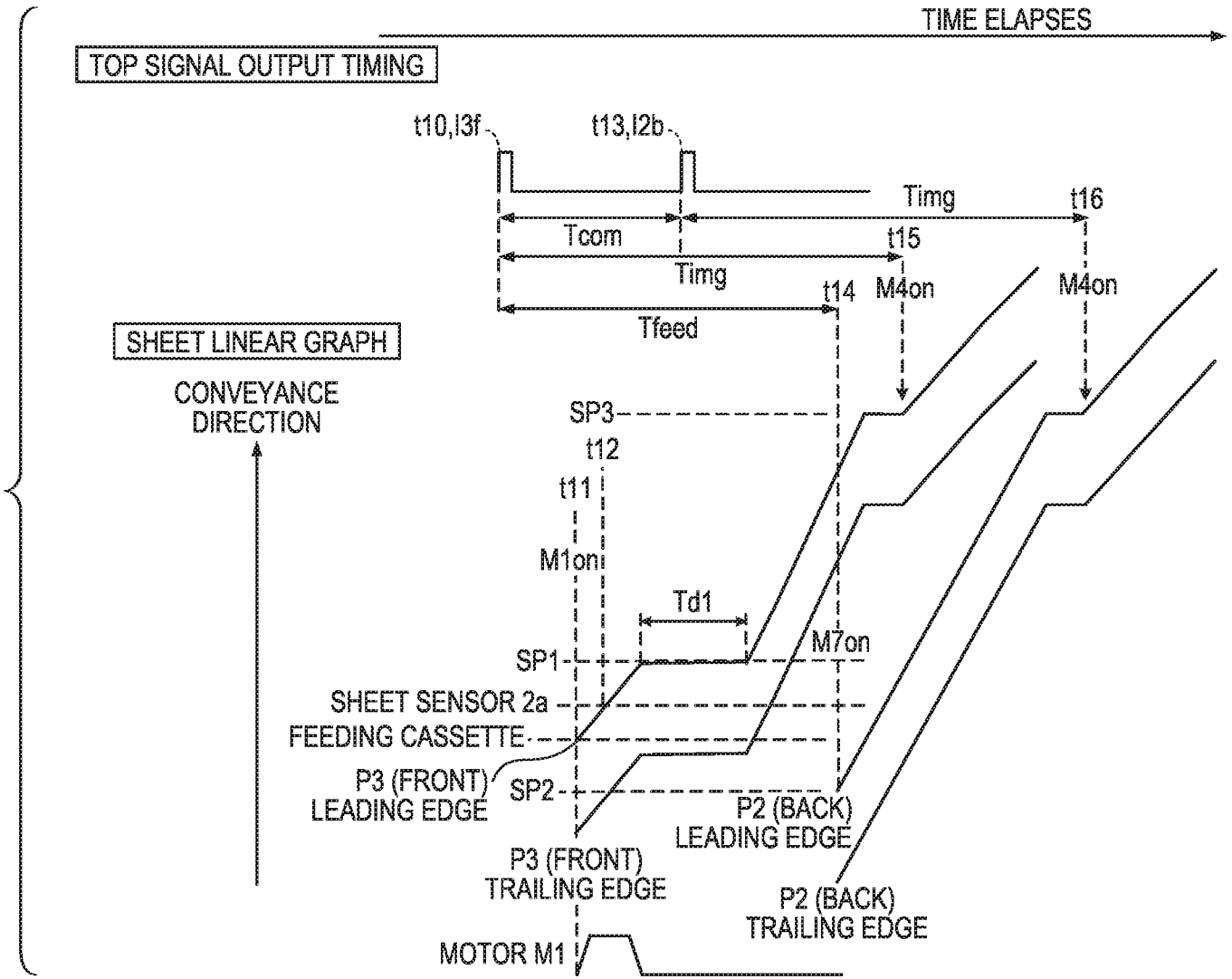
FIG. 9 is a diagram for describing control timings.

FIG. 9 is a diagram describing a relationship between positions of sheets, feed timings, and TOP signals in the case 0 (FIGS. 4 and 5). At a time t10, the CPU 201 outputs a TOP signal in order to start the formation of the toner image I3*f*. At a time t11, the CPU 201 outputs an M1on signal in order to activate the motor M1 and then starts the feeding of the sheet P3 by the motor M1. An interval between the time t10 and the time t11 is normally a constant. At a time t12, the CPU 201 detects that the sheet sensor 2*a* has turned on. When the leading edge of the sheet P3 arrives at the position SP1, the CPU 201 stops the conveyance of the sheet P3 only for a duration of the time Td1. The position SP1 is between the rollers 1*c* and the rollers 1*d*. Td1 is a time for correcting a variation in a time (a travel time) that the sheet P3, which started being fed at the time t11, took to reach the position SP1. Td1 is adjusted to be short if the travel time is long, and Td1 is adjusted to be long if the travel time is short. As described above, by correcting a feed variation using Td1, a travel timing of the sheet P to a position SP3 is controlled to be a constant.

In a case where the sheet P3 is delayed to a point that Td1 cannot be allocated, the sheet P3 arrives later than the toner image I3*f* in relation to the secondary transfer unit 140. In FIG. 5, the toner image I1*b* is approaching the secondary transfer unit 140. On the transfer belt 130, further on an upstream side of the toner image I1*b*, the toner image I3*f* has already been transferred. Even further on the upstream side, a transfer of the toner image I2*b* onto the transfer belt 130 has been started.

As illustrated in FIG. 9, the sheet sensor 2*a* detects the sheet P3 at the time t12 and then the CPU 201 outputs the TOP signal for the toner image I2*b* at a time t13. An interval between a preceding TOP signal and a next TOP signal is Tcom. For example, in a case where productivity of the image forming apparatus 100 is 80 ppm (ppm=a number of output sheets per minute), Tcom is 750 ms. However, the productivity is predefined depending on a size of sheets or a type of sheets (weight and such). The CPU 201 generates an M4on signal at times t15 and t16, which are after a time Timg has elapsed from the times t10 and t13, respectively, when the TOP signal was outputted. By this, the motor M4 is activated, the rollers 1*f* rotate, and then the conveyance of sheets P3 and P2 stopped at the position SP3 is resumed. The time Timg is a predetermined time based on a difference between a time that a toner image formed by the TOP signal as a trigger reaches the secondary transfer unit 140 and a time that the sheet P starts moving based on the M4on signal and then reaches the secondary transfer unit 140.

A refeed timing of the sheet P2 is a time t14 when a predetermined time Tfeed has elapsed from the time t10. In other words, at the time t14, the sheet P2 waiting at the position SP2 is re-fed. The re-feed is realized by the rollers 1*k* to In and the rollers 1*d* and 1*e*. The motor M7 is driven by an M7on signal and then the rollers 1*k* to In rotate. The motor M3 is driven by an M3on signal and then the rollers 1*d* and 1*e* rotate. An output timing of the M3on signal in re-feed may be the same as an output timing of the M7on signal. The re-fed sheet P2 is conveyed to the rollers 1*f* and then stops at the position SP3.

Comparative Example

Figure 10:
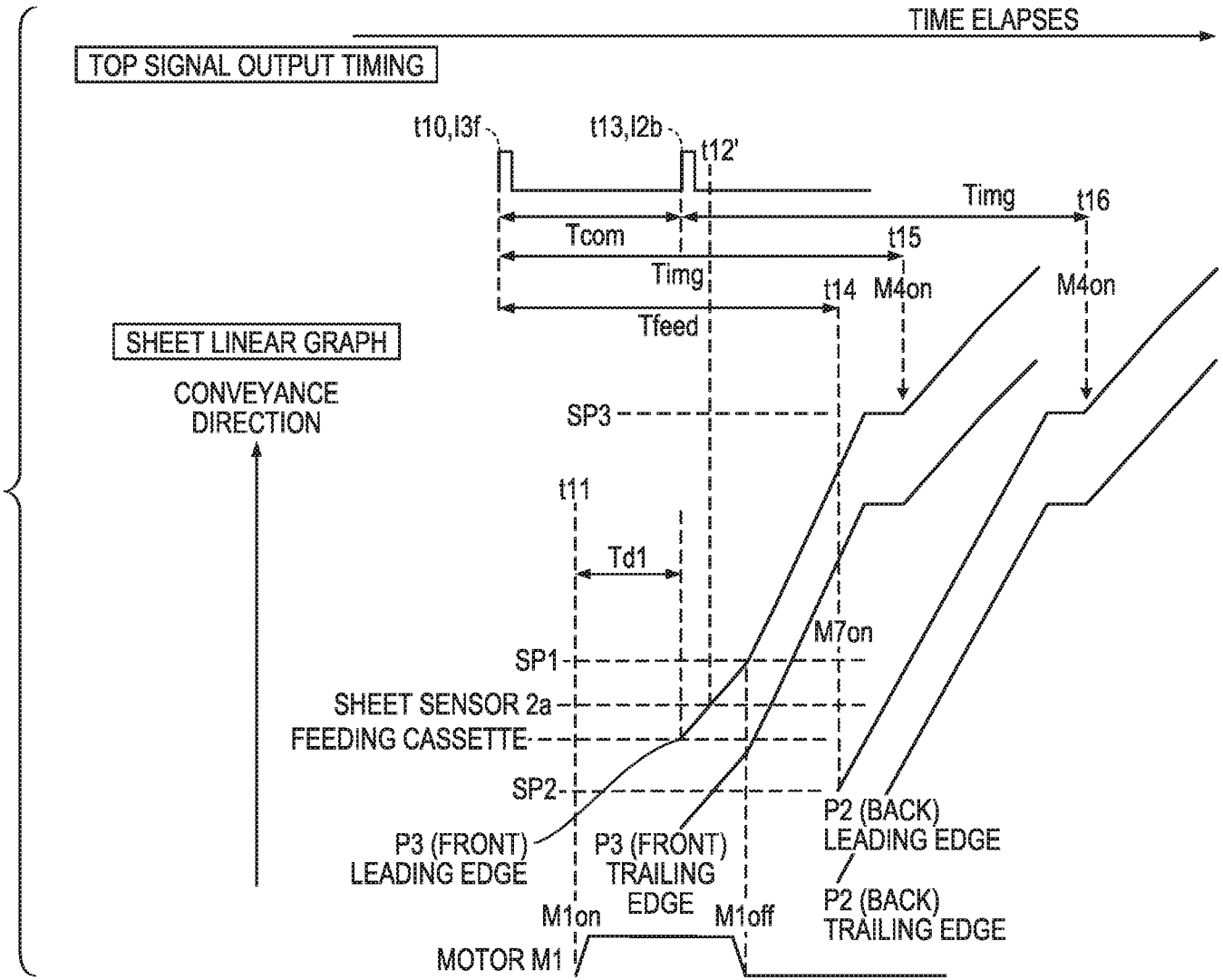
FIG. 10 is a diagram for describing control timings.

FIG. 10 illustrates a case (a comparative example) where a feeding of the sheet P3 is delayed by Td1. This comparative example is a case where the CPU 201 does not wait for the sheet sensor 2*a* to detect the sheet P3 and then outputs a TOP signal at the time t13.

As it becomes discernable by comparing FIGS. 10 and 9, although the motor M1 is activated at the time t11, a timing that the sheet P3 arrives at the sheet sensor 2*a* is a time t12-1 which is delayed from the time t12 by the time Td1. Thus, the CPU 201 adjusts the time Td1, over which the sheet P3 is stopped at the position SP1, to 0. Accordingly, the sheet P3 is conveyed without stopping at the position SP1.

Note that because the sheet P3 arrives at the secondary transfer unit 140 late in relation to the toner image I3*f* if the delay time of the sheet P3 exceeds Td1, the CPU 201 must determine that a jam has occurred regarding the sheet P3. As described above, if the CPU 201 does not wait for the sheet sensor 2*a* to detect the sheet P3 and then outputs a TOP signal at the time t13, the sheet P2 will be fouled.

Embodiment

As described in the comparative example, if the CPU 201 outputs a TOP signal before the sheet sensor 2*a* detects the sheet P3, the sheet P2 will be fouled. In order to solve this, in the present embodiment, the CPU 201 waits until the sheet sensor 2*a* detects the sheet P3 and then outputs the TOP signal. By this, the sheet P2 is less likely to be fouled.

Figure 11:
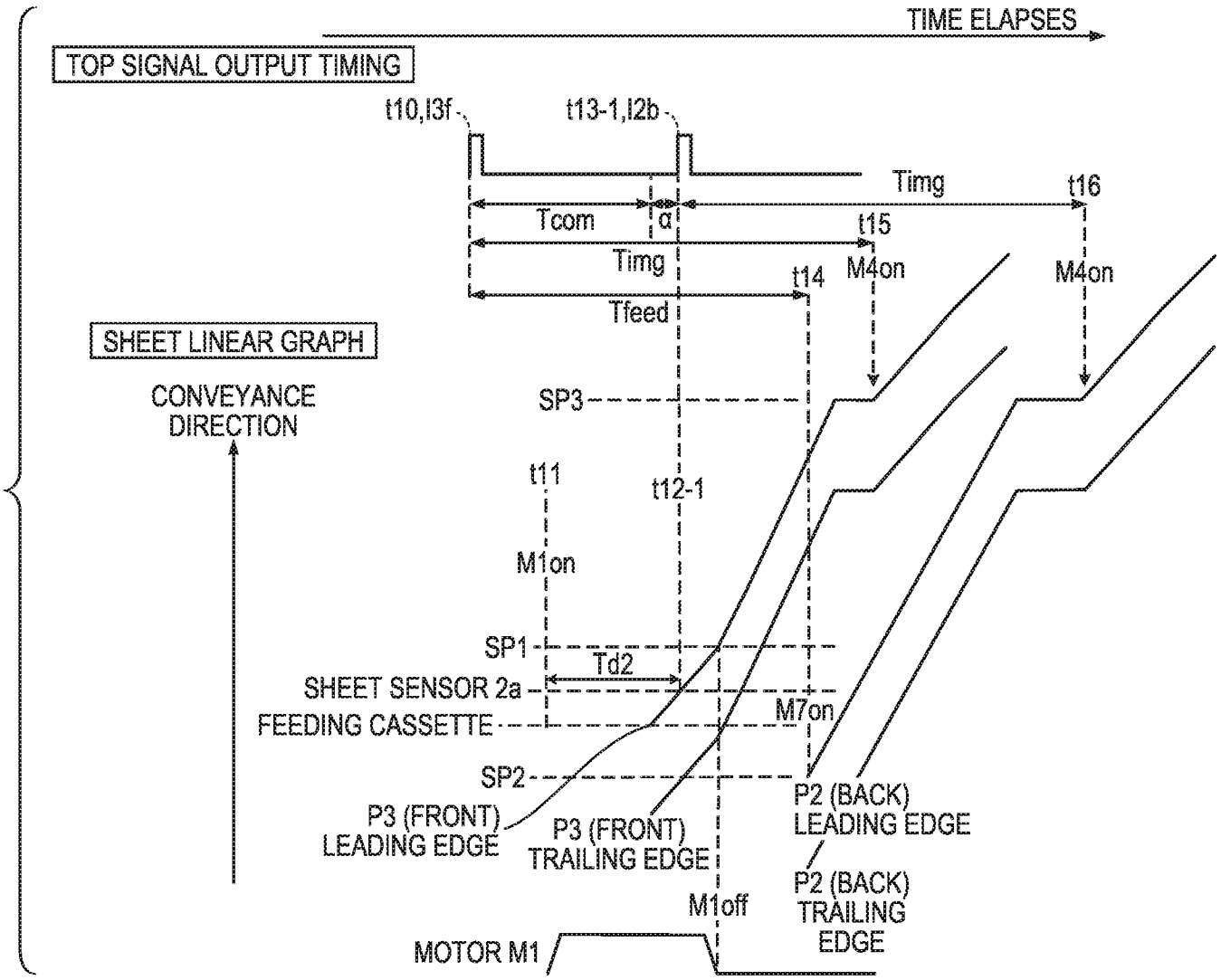
FIG. 11 is a diagram for describing control timings.

In FIG. 11, because the sheet P3 is delayed, it is conveyed without being stopped at the position SP1 (Td1=0). In this case, it is assumed that a time it took from the time t11 to the time t12-1 when the sheet sensor 2*a* turns on is Td2. A time t13-1 when the TOP signal for the toner image I2*b* is outputted in FIG. 11 in relation to the time t13 when the TOP signal for the toner image I2*b* is outputted in FIG. 10 is delayed by a time a. Note that the time t13-1 matches the time t12-1 when the sheet sensor 2*a* is turned on. In other words, even if the time Tcom has elapsed from the time t10 when the TOP signal for the sheet P3 was outputted, unless the sheet sensor 2*a* regarding the sheet P3 is turned on, the CPU 201 delays the output of the TOP signal for the toner image I2*b*. As described in FIG. 9, the CPU 201 generates a TOP signal in a case where the sheet sensor 2*a* is already turned on when the time Tcom has elapsed from the time t10. In other words, it can be said that in the present embodiment, in a case where the feed delay does not occur, there is no influence on productivity. The conveyance and image formation of sheets after passing through the position SP1 is as described in FIG. 10.

Figure 12:
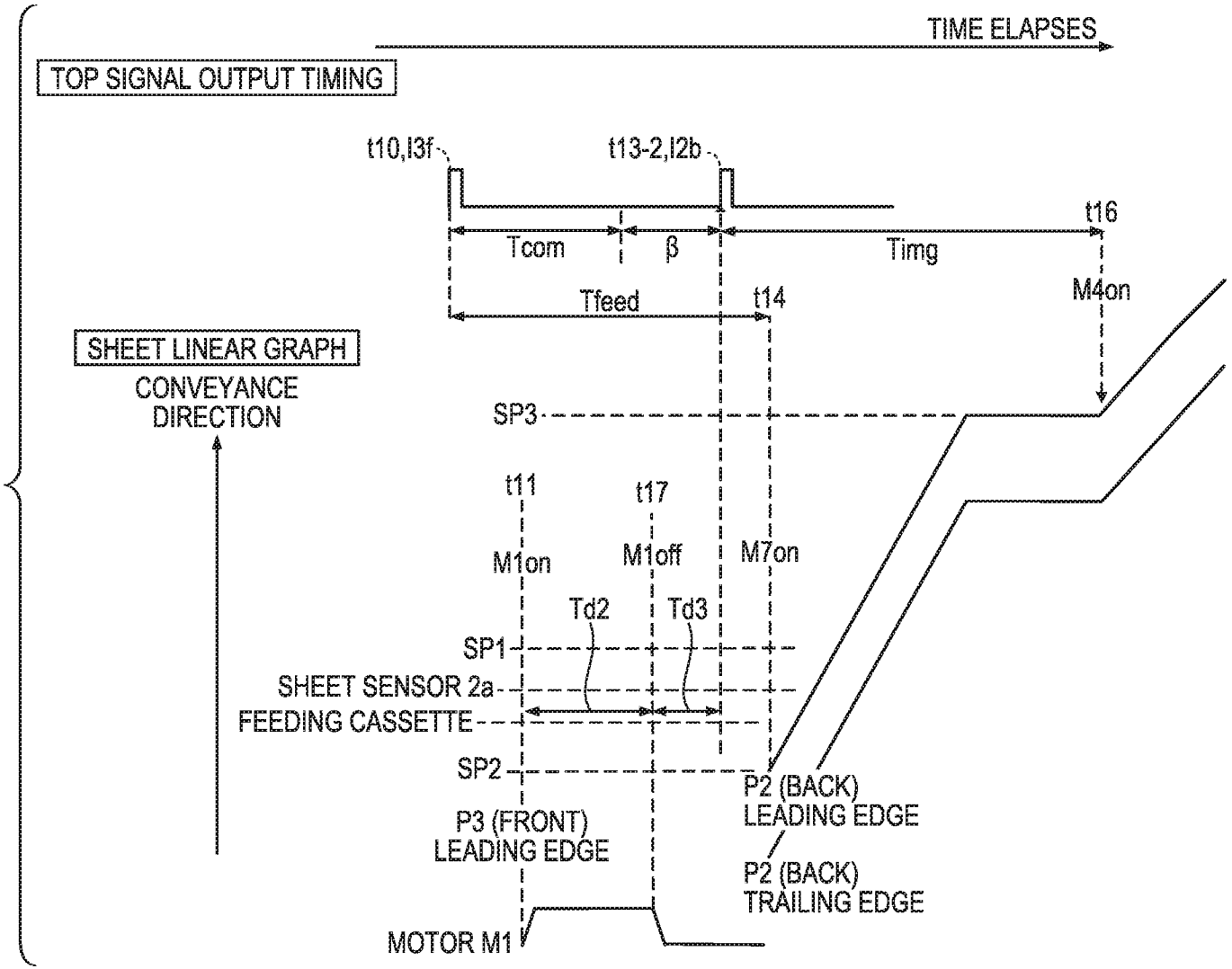
FIG. 12 is a diagram for describing control timings.

A case illustrated in FIG. 12 is a case where feeding of the sheet P3 is further delayed than the case illustrated in FIG. 11. In this case, the sheet sensor 2*a* is unable to detect the sheet P3 even at a time t17 when the time Td2 has elapsed from the time tn. Accordingly, the CPU 201 stops the motor M1. Furthermore, the CPU 201 outputs the TOP signal for the toner image I2*b* at a time t13-2 when a time Td2+Td3 has elapsed from the time tn.

As illustrated in FIG. 12, the time t13-2 is a time when a time Tcom+β has elapsed from the time t10. Compared to FIG. 11, in FIG. 12, the time t13-2 when the TOP signal for the toner image I2*b* is outputted is delayed by a time 3-*a* in relation to the time t13-1. As described using FIG. 3C, if a time T2 can be allocated, the toner image I3*f* that was formed for the sheet P3, which is not detected by the sheet sensor 2*a*, can be cleaned by the cleaning voltage and the belt cleaner 131. In FIG. 12, the image formation interval between the toner image I3*f* and the toner image I2*b* is extended to Tcom+β=T2 in order to allocate the time for the cleaning. By this, the toner image I3*f* can be removed from the secondary transfer unit 140, and thus, even if the toner image I2*b* is transferred onto the second side of the sheet P2, the first side of the sheet P2 will be less likely to be fouled by the toner image I3*f*. Note that because the formation of the toner image I2*b* is delayed, the CPU 201 causes the sheet P2 that was re-fed from the double-sided conveyance path to wait at the position SP3.

Figure 13:
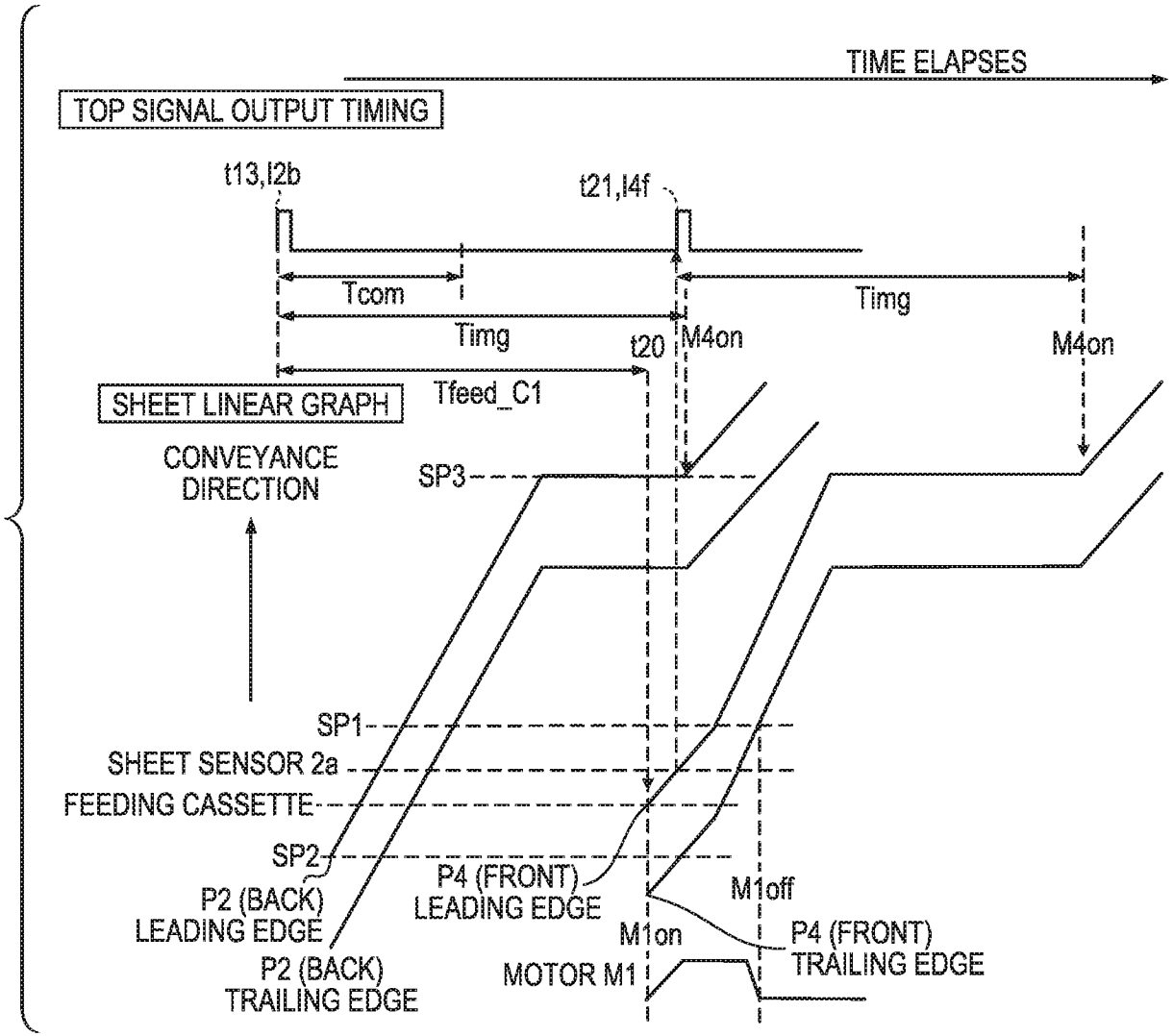
FIG. 13 is a diagram for describing control timings.

Incidentally, because the transferring of the toner image I3*f* in relation to the sheet P3 failed, the CPU 201, as illustrated in FIG. 3D, forms the toner image I3*f* (140 again as the page after the toner image I2*b*. Thereby, as illustrated in FIG. 13, the CPU 201 executes an image formation retry of the toner image I3*f*. Here, it is assumed that an image that is the same as the toner image I3*f* is formed as the toner image I4*f*. Also, although a sheet P4 in FIG. 13 is described as a sheet fed next from the feeding cassette 20 after P2, the sheet P3 and the sheet P4 are essentially the same sheet.

As illustrated in FIG. 3D, the image formation interval between the toner image I2*b* and the toner image I4*f* is T3. The CPU 201 starts the driving of the motor M1 at a time t20 when a time Tfeed_C1 elapses from the time t13. Because the sheet sensor 2*a* detected the sheet P4 at a time t21, the CPU 201 outputs the TOP signal for the toner image I4*f*. In the image formation retry, it is assumed that the CPU 201 does not generate a TOP signal until a feeding of the sheet P4 is successful. Furthermore, the CPU 201 may improve the probability of the feeding being successful by executing the feeding under a condition that is advantageous for the feeding of the sheet P4. An advantageous condition, for example, is to cause the acceleration of the motor M1 to be lower than a default setting value. Another advantageous condition is to cause the feeding speed (the rotation speed of the motor MD of the sheet P4 to be lower than a default setting value. Another advantageous condition is to provide vibrations to the sheet P4 by repeatedly driving and stopping the motor M1. At least one of a plurality of these advantageous conditions is executed.

The CPU 201 continuously conveys the sheet P4 without stopping it at SP1. This is to improve productivity.

Flowchart

Figure 14:
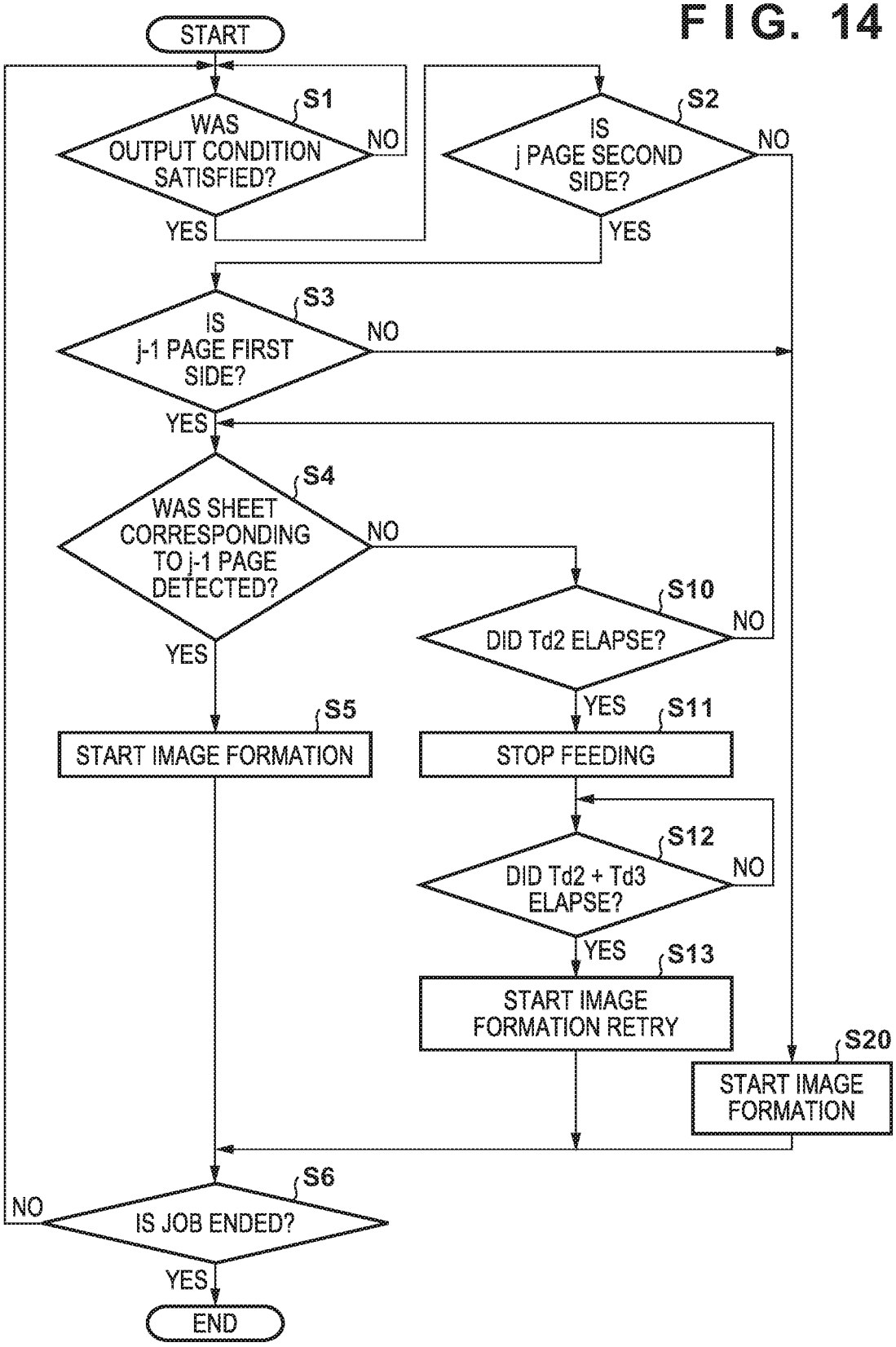
FIG. 14 is a flowchart for describing image formation control.

FIG. 14 is a diagram for describing image formation control of a toner image. Here, image formation control in relation to a sheet fed from the feeding cassette 20 mainly is described primarily. Although not illustrated in FIG. 14, temperature control of the fixing device 170, switching control of the flapper 4*a*, and conveyance control related to the conveyance paths 3*a* to 3*e* are executed, as previously described, simultaneously with the image formation control.

The CPU 201 executes the following steps when the double-sided printing job is inputted from the UI 230. The CPU 201, by analyzing the double-sided printing job, creates and then holds in the RAM 203 monitoring information for each page. The monitoring information may be created with a toner image as a page. The monitoring information includes control information indicating that a toner image on a j-th page is formed on a first side (or a second side) of an i-th sheet P.

In step S1, the CPU 201 determines whether or not an output condition of a TOP signal is satisfied. An output condition for a first sheet and an output condition for a second and subsequent sheets of a job are different. The output condition of the first sheet is that the processing unit 120 is in a state in which image formation is possible. It is assumed that the CPU 201 monitors via the image forming unit 250 whether or not the processing unit 120 is capable of image formation. A fundamental output condition regarding the second and subsequent sheets is that the time Tcom has elapsed from a time an immediately previous TOP signal was outputted. The CPU 201 advances the processing to step S2 when the output condition is satisfied.

In step S2, the CPU 201 determines whether or not the j-th page that is the image formation target is a second side of a sheet. The CPU 201 holds the monitoring information for each page in the RAM 203. The CPU 201 determines whether the j-th page is a toner image of a second side or a toner image of a first side of a sheet by referring to the monitoring information regarding the j-th page. The CPU 201 advances the processing to step S3 if the j-th page is a second side.

In step S3, the CPU 201 determines whether or not a (j−1)th page is a toner image of a first side. The CPU 201 advances the processing to step S4 if the (j−1)th page is a toner image of a first side.

In step S4, the CPU 201 determines whether or not a sheet corresponding to the (j−1)th page has been detected by the sheet sensor 2*a*. The sheet corresponding to the (j−1)th page is a sheet onto which a toner image of the (j−1)th page is scheduled to be transferred. The CPU 201 advances the processing to step S5 if the sheet has been detected by the sheet sensor 2*a*.

In step S5, the CPU 201 generates and then outputs to the image forming unit 250 a TOP signal for a (j−1)th page in order to start the image formation of a toner image. The image forming unit 250 receives the TOP signal and then outputs an image signal to the exposure device 110. The exposure device 110 outputs a laser beam in accordance with the image signal. By this, the processing unit 120 starts the image formation of the toner image. In step S6, the CPU 201 refers to the monitoring information in order to determine whether or not the job has ended. If the job is ended, the CPU 201 ends the image formation processing of the example. The CPU 201 advances the processing to step S1 if the job is not ended.

In step S4, if it is determined that a sheet is not detected, the CPU 201 advances the processing to step S10. In step S10, the CPU 201 determines whether or not the predetermined time Td2 has elapsed from the time the feeding of the sheet was started. The CPU 201 advances the processing to step S4 if the predetermined time Td2 has not elapsed. The CPU 201 advances the processing to step S11 if the predetermined time Td2 has elapsed. As described above, steps S4 and S10 determine whether or not a sheet is detected within the predetermined time Td2.

In step S11, the CPU 201 stops the motor M1 in order to stop the feeding of a sheet from the feeding cassette 20. In step S12, the CPU 201 determines whether or not Td2+Td3 has elapsed from the time the feeding was started. If Td2+Td3 has not elapsed from a time when the feeding is started, the CPU 201 waits for Td2+Td3 to elapse from a time when the feeding is started. By this, an image that was scheduled to be transferred onto a sheet that failed to be fed is cleaned. The CPU 201, during Td2+Td3, applies the cleaning voltage from the transfer power supply 1530 onto the secondary transfer unit 140 and then cleans the toner image. If Td2+Td3 has elapsed from the time the feeding is started, the CPU 201 advances the processing to step S13. As described above, in steps S10 to S12, the toner image that was scheduled to be transferred onto the sheet that was not detected within the predetermined time Td2 is cleaned.

In step S13, the CPU 201 executes an image formation retry. As described using FIG. 13, the CPU 201 activates the motor M1 at a predetermined timing in order to start the feeding of a sheet. Furthermore, the CPU 201 generates and outputs a TOP signal to the image forming unit 250. By this, a cleaned toner image is formed again.

Incidentally, in a case where an image formation target page in step S2 is not a toner image of a second side, the CPU 201 advances the processing to step S20. In step S20, the CPU 201 generates and outputs a TOP signal in order to start the image formation of a toner image. Then, the CPU 201 advances the processing to step S6.

Note that if the sheet P4 is not detected by the sheet sensor 2*a*, it may be determined that a sheet jam has occurred, the image forming operation may be stopped, and the user may be made to perform jam processing.

CPU Functions

As illustrated in FIG. 15, the CPU 201 executes a control program in order to realize various functions. One or all of these functions may be realized by a hardware circuit such as an ASIC or an FPGA. An ASIC is an abbreviation for an application specific integrated circuit. An FPGA is an abbreviation for a field programmable gate array.

An image formation control portion 1500 uses several timers in order to control an output timing (an image formation timing) of the TOP signal mainly. A feeding control portion 1510 uses several timers in order to control the feeding and the conveyance of the sheet P mainly. Here, functions related to the feeding and the re-feeding of the sheet P mainly are described.

A Tcom timer 1501 included in the image formation control portion 1500 is a timer that times the predetermined time Tcom. The Tcom timer 1501 is reset when a TOP signal is inputted. A delay determination unit 1502 determines whether or not the predetermined time Tcom has elapsed. Also, the delay determination unit 1502, when the predetermined time Tcom has elapsed, determines whether or not the sheet sensor 2*a* has already detected a sheet. In a case where the sheet sensor 2*a* has already detected a sheet when the predetermined time Tcom has elapsed, the delay determination unit 1502 outputs a TOP signal. If that is not the case, the delay determination unit 1502 does not output a TOP signal.

A Td2 timer 1503 is a timer that starts timing a threshold time Td2 when feeding from the feeding cassette 20 is started. A jam determination unit 1504 determines whether or not the sheet sensor 2*a* has detected a sheet before the Td2 timer 1503 completes the timing of the threshold time Td2. If a sheet is detected within the threshold time Td2, the jam determination unit 1504 outputs a TOP signal. In a case (a Td2 timeout) where a sheet is not detected within the threshold time Td2, the jam determination unit 1504 determines that a feed jam has occurred to the sheet and does not output a TOP signal.

A Td3 timer 1505 is a timer in charge of an image formation retry. The Td3 timer 1505 starts timing a margin time Td3 when a Td2 timeout occurs. The Td3 timer 1505, when the timing of the margin time Td3 is complete, outputs a TOP signal. By this, an image formation retry is executed.

A Tfeed timer 1511 included in the feeding control portion 1510 is a timer that times a predetermined time Tfeed when a TOP signal is inputted. The Tfeed timer 1511, when the timing of the predetermined time Tfeed is complete, outputs the M7on signal and the M3on signal. By this, a sheet is re-fed from a re-feeding unit and then an image is formed on a second side of a sheet.

A Timg timer 1512 is a timer that starts timing a predetermined time Timg when the TOP signal is inputted. The Timg timer 1512, when the timing of the predetermined time Timg is complete, outputs the M4on signal, drives the motor M4, and thereby rotates the rollers 1*f*. By this, a timing that the sheet P arrives at the secondary transfer unit 140 and a timing that a toner image arrives at the secondary transfer unit 140 are synchronized.

A Tfeed_c1 timer 1513 is a timer that times a predetermined time Tfeed_c1 when the TOP signal for an image formation retry is inputted. The Tfeed_c1 timer 1513 completes timing the predetermined time Tfeed_c1, outputs the M1on signal, and then activates the motor M1. Note that for the TOP signal to be inputted means to use the TOP signal as a trigger.

A cleaning control unit 1520, in a case where the sheet sensor 2*a* does not detect a sheet even after a predetermine time has elapsed, causes the transfer power supply 1530 to output the cleaning voltage. By applying the cleaning voltage onto the secondary transfer unit 140, toner is retransferred from the secondary transfer unit 140 onto the transfer belt 130 and then is collected by the belt cleaner 131. The transfer power supply 1530 may be, for example, a part of the image forming unit 250.

SUMMARY

As illustrated in FIG. 1, the image forming apparatus 100 is an example of an image forming apparatus capable of forming an image on both a first side and a second side of a sheet. The image forming apparatus 100 may be realized by any of a printer, a facsimile apparatus, a copying machine, or a multi-function peripheral. The exposure device 110, the processing unit 120, and such function as an image forming unit for forming a toner image onto an image bearing member. The transfer belt 130 and the photosensitive drum are examples of the image bearing member. The motor M1 and the roller 1*a* function as a feeder for feeding a sheet. The CPU 201 functions as a controller for controlling a timing for forming a toner image onto the image bearing member and a timing for feeding a sheet. The sheet sensor 2*a* functions as a sheet detector for detecting a sheet in a first conveyance path for conveying a sheet (e.g., the conveyance path 3*a*). The secondary transfer unit 140 functions as a transfer unit for transferring a toner image formed on the image bearing member onto a sheet. The transfer power supply 1530 for generating a cleaning voltage functions as a voltage supply unit for supplying the cleaning voltage to the transfer unit. The rollers 1*f* function as control rollers for controlling conveyance of a sheet so as that a timing that the sheet arrives at the transfer unit and a timing that a toner image conveyed by the image bearing member arrives at the transfer unit coincide. The rollers 1*f* function as controllers for controlling a timing for forming a toner image onto the image bearing member and a timing for feeding a sheet. The fixing device 170 functions as a fixing unit for fixing onto a sheet a toner image transferred onto the sheet from the transfer unit. The rollers In arranged in the conveyance path 3*e* function as a re-feeder for re-feeding a sheet to the transfer unit in order to transfer a toner image onto a second side of the sheet onto whose first side a toner image has been fixed. The CPU 201 outputs to the image forming unit a first start signal for causing the image forming unit to start forming a toner image to transfer onto a first side of an i-th sheet P3. The TOP signal described above is an example of a start signal. The CPU 201 causes the feeder to start feeding the i-th sheet P3. As illustrated in FIG. 9, the CPU 201, when a predetermined time (e.g., Tcom) has elapsed from when the first start signal was outputted, determines whether or not the i-th sheet has already been detected by the sheet detector. There are cases where, when the predetermined time has elapsed from when the first start signal was outputted, the i-th sheet has already been detected by the sheet detector. In such a case, the CPU 201 outputs to the image forming unit a second start signal for causing the image forming unit to start forming a toner image (e.g., I2*b*) to be transferred onto a second side of an (i−1)th sheet P2 waiting at the re-feeder. There are cases where, when the predetermined time has elapsed from when the first start signal was outputted, the i-th sheet has not yet been detected by the sheet detector. In such a case, as illustrated in FIG. 11, the CPU 201 waits until the i-th sheet P3 is detected by the sheet detector and then outputs to the image forming unit the second start signal. By this, productivity in the double-sided image formation is maintained.

There are cases where, when the predetermined time has elapsed from when the first start signal was outputted, the i-th sheet has not yet been detected by the sheet detector. So, there are cases where, after waiting until the i-th sheet is detected by the sheet detector, the i-th sheet is detected by the sheet detector within a threshold time (e.g., Td2) from when the feeding of the i-th sheet was started. In such a case, the CPU 201 outputs the second start signal to the image forming unit. On the other hand, there are cases where the i-th sheet is not detected by the sheet detector within a threshold time. In such a case, the CPU 201 interrupts the feeding of the i-th sheet by the feeder. Furthermore, the CPU 201 supplies the cleaning voltage to clean the toner image which was supposed to be transferred onto a first side of the i-th sheet adhered to the transfer unit and then outputs the second start signal to the image forming unit. By this, a fouling of the (i−1)th sheet by the toner adhered to the transfer unit is reduced without employing an expensive cleaning mechanism.

The CPU 201, after the feeding of the i-th sheet is interrupted and the feeding of the (i−1)th sheet by the re-feeder is executed, causes the feeder to execute the re-feeding of the i-th sheet. By this, an opportunity for image formation in relation to the i-th sheet for which the feeding failed is granted again.

The motor M1 functions as a motor for driving the feeder. The CPU 201 may cause the acceleration of the motor adopted for the re-feeding of the i-th sheet to be lower than the acceleration of the motor adopted for the feeding of the i-th sheet. The CPU 201 may cause the rotation speed of the motor adopted for the re-feeding of the i-th sheet to be lower than the rotation speed of the motor adopted for the feeding of the i-th sheet. The CPU 201 may provide vibrations to a sheet by repeating rotation and stoppage of the motor and then re-feed the i-th sheet. By this, probability of the re-feeding of the i-th sheet being successful would improve.

The threshold time (e.g., Td2) may be a time set in order to determine a sheet fed by the feeder as jammed. In a case where the feeding of the i-th sheet by the feeder is interrupted, a timing the second start signal is outputted may be a timing when a margin time (e.g., Td3) has elapsed from a time when the threshold time elapsed. The margin time may be, for example, a time for completing the supply of the cleaning voltage to the transfer unit by a voltage supply unit. By this, a next toner image will end up arriving at the transfer unit after the transfer unit fouled by an image for the first side of the i-th sheet is cleaned sufficiently.

The transfer power supply 1530 functions as the voltage supply unit for supplying the cleaning voltage to the transfer unit so that the toner adheres again in relation to the image bearing member from the transfer unit. The belt cleaner 131 functions as the collection unit for collecting the toner that adhered again onto the image bearing member. By employing such a configuration and units, it becomes possible to realize a low cost cleaning mechanism.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-197645, filed Oct. 30, 2019, which is hereby incorporated by reference herein in its entirety.

What is claimed is:

1. An image forming apparatus for forming an image on both a first side and a second side of a sheet, the apparatus comprising:

an image forming unit configured to form a toner image on an image bearing member;

a feeder configured to feed a sheet;

a sheet detector configured to detect the sheet in a first conveyance path for conveying the sheet;

a transfer unit configured to transfer the toner image formed on the image bearing member onto the sheet;

a controller configured to control a timing for forming the toner image on the image bearing member and a timing for feeding the sheet and to control a conveyance of the sheet so that a timing that a toner image conveyed by the image bearing member arrives at the transfer unit and a timing that the sheet arrives at the transfer unit coincide;

a fixing unit configured to fix onto the sheet the toner image transferred onto the sheet from the transfer unit; and a re-feeder configured to re-feed the sheet to the transfer unit in order to transfer a toner image onto a second side of the sheet onto whose first side the toner image has been fixed, wherein the controller is configured to:

after outputting a first start signal for causing the image forming unit to start formation of a toner image to be transferred onto a first side of an i-th sheet, cause the feeder to start feeding of the i-th sheet;

determine, when a predetermined time has elapsed from when the first start signal was outputted, whether or not the i-th sheet has already been detected by the sheet detector;

in a case where the i-th sheet has been detected by the sheet detector before a first predetermined time has elapsed from when the first start signal was outputted, output a second start signal for causing the image forming unit to start formation of a toner image to be transferred onto a second side of an (i−1)th sheet waiting at the re-feeder; and in a case where the i-th sheet has not been detected by the sheet detector before the first predetermined time has elapsed from when the first start signal was outputted, output the second start signal after the i-th sheet is detected by the sheet detector.

2. The image forming apparatus according to claim 1, further comprising:

a voltage supply unit configured to supply to the transfer unit a cleaning voltage for cleaning the transfer unit, wherein the controller is further configured to:

in a case where the i-th sheet has not been detected by the sheet detector before the first predetermined time has elapsed from when the first start signal was outputted and where the i-th sheet has been detected by the sheet detector after the first predetermined time has elapsed from when the first start signal was outputted and within a second predetermined time from when the feeding of the i-th sheet was started, output the second start signal; and in a case where the i-th sheet has not been detected by the sheet detector before the first predetermined time has elapsed from when the first start signal was outputted, and where the i-th sheet has not been detected by the sheet detector before the second predetermined time has elapsed from when the feeding of the i-th sheet was started, interrupt the feeding of the i-th sheet by the feeder, control to cause the voltage supply unit to clean the toner image to have been transferred on a first side of the i-th sheet adhered onto the transfer unit, and then output the second start signal.

3. The image forming apparatus according to claim 2, wherein the controller is further configured to:

after the feeding of the i-th sheet is interrupted and feeding of the (i−1)th sheet by the re-feeder is executed, cause the feeder to execute re-feeding of the i-th sheet.

4. The image forming apparatus according to claim 3, further comprising:

a motor configured to drive the feeder, wherein the controller causes an acceleration of the motor for the re-feeding of the i-th sheet to be lower than an acceleration of the motor for the feeding of the i-th sheet.

5. The image forming apparatus according to claim 3, further comprising:

a motor configured to drive the feeder, wherein the controller causes a rotation speed of the motor for the re-feeding of the i-th sheet to be lower than a rotation speed of the motor for the feeding of the i-th sheet.

6. The image forming apparatus according to claim 3, further comprising:

a motor configured to drive the feeder, wherein the controller imparts a vibration in the sheet by repeating a rotation and a stoppage of the motor and then re-feeds the i-th sheet.

7. The image forming apparatus according to claim 2, wherein the second predetermined time is a time set in order to determine the sheet fed by the feeder is jammed.

8. The image forming apparatus according to claim 2, wherein in a case where the feeding of the i-th sheet by the feeder has been interrupted, a timing for the second start signal to be outputted is a timing when a predetermined margin time has further elapsed from a time when the second predetermined time elapsed.

9. The image forming apparatus according to claim 8, wherein the predetermined margin time is a time for completing a supply of the cleaning voltage from the voltage supply unit.

10. The image forming apparatus according to claim 2, further comprising a collection unit, wherein the cleaning voltage is a voltage that causes toner to adhere again onto the image bearing member from the transfer unit, and the collection unit collects toner adhered again onto the image bearing member.

* * * * *